United States Patent [19]

Niese et al.

[11] Patent Number: 4,995,210

[45] **Date of Patent: * Feb. 26, 1991**

[54] FREE FLOATING FLOOR SYSTEM AND METHOD FOR FORMING

[75] Inventors: Michael Niese; James H. Stoehr, both of Cincinnati, Ohio

[73] Assignee: Robbins, Inc., Cincinnati, Ohio

[ * ] Notice: The portion of the term of this patent subsequent to May 23, 2006 has been disclaimed.

[21] Appl. No.: 352,284

[22] Filed: May 16, 1989

Related U.S. Application Data

[63] Continuation-in-part of Ser. No. 162,088, Feb. 29, 1988, Pat. No. 4,831,806.

[51] Int. Cl.[5] ..... E04F 13/08

[52] U.S. Cl. ..... 52/391; 52/410; 52/747

[58] Field of Search ..... 52/372, 375, 376, 377, 52/391, 393, 403, 410, 480, 747

[56] References Cited

U.S. PATENT DOCUMENTS

| | | |
|---|---|---|
| Re. 18,573 | 8/1932 | Kocher . |
| Re. 26,239 | 7/1967 | Rockabrand et al. . |
| 174,261 | 2/1876 | Kuhn . |
| 392,810 | 11/1888 | Kelley . |
| 890,436 | 6/1908 | Momberg . |
| 968,512 | 8/1910 | Praray . |
| 975,923 | 11/1910 | Praray . |
| 1,407,679 | 2/1922 | Ruthrauff . |
| 1,587,355 | 6/1926 | Raun . |
| 1,675,226 | 6/1928 | Munroe et al. . |
| 1,752,583 | 4/1930 | Wright . |
| 1,781,117 | 11/1930 | Mackie et al. . |
| 1,940,377 | 12/1923 | Storm . |
| 2,004,917 | 6/1935 | Johnson . |
| 2,008,244 | 7/1935 | Crooks . |
| 2,046,593 | 7/1936 | Urbain . |
| 2,085,215 | 6/1937 | Gonzalez . |
| 2,092,694 | 9/1937 | Crooks . |
| 2,111,528 | 3/1938 | Cherry . |
| 2,116,737 | 5/1938 | Urbain . |
| 2,119,804 | 6/1938 | Crooks . |
| 2,151,505 | 3/1939 | Elmendorf . |
| 2,167,835 | 8/1939 | Greulich . |
| 2,227,878 | 1/1941 | Crooks . |
| 2,263,895 | 11/1941 | Larsen . |
| 2,316,671 | 4/1945 | Crooks . |
| 2,391,250 | 12/1945 | Legowik . |
| 2,554,657 | 5/1951 | Betterton et al. . |
| 2,743,487 | 5/1956 | Kuhlman . |
| 2,807,057 | 9/1957 | Mondry . |
| 2,823,427 | 2/1958 | Kuhlman . |
| 2,862,255 | 12/1958 | Nelson . |
| 2,882,560 | 4/1959 | Plendl . |
| 3,026,578 | 3/1962 | Hundley . |
| 3,031,725 | 5/1962 | Omholt . |
| 3,045,294 | 7/1962 | Livezey, Jr. . |
| 3,267,630 | 8/1966 | Omholt . |
| 3,270,475 | 9/1966 | Kodaras . |
| 3,271,916 | 9/1966 | Omholt . |
| 3,310,919 | 3/1967 | Bue et al. . |
| 3,387,422 | 6/1968 | Wanzer . |
| 3,473,281 | 10/1969 | Omholt . |

(List continued on next page.)

FOREIGN PATENT DOCUMENTS

| | | | |
|---|---|---|---|
| 940934 | 11/1958 | Fed. Rep. of Germany . | |
| 2103383 | 1/1971 | Fed. Rep. of Germany . | |
| 998158 | 1/1952 | France . | |
| 1097007 | 9/1955 | France | 52/393 |
| 359883 | 11/1938 | Italy . | |
| 280400 | 6/1927 | United Kingdom . | |

*Primary Examiner*—David A. Scherbel
*Assistant Examiner*—Jerrold D. Johnson
*Attorney, Agent, or Firm*—Wood, Herron & evans

[57] ABSTRACT

A free floating hard wood floor system has upper and lower subfloors sandwiched to provide a monolithic panel system which supports the floorboards above with optimum rigidity and integrity at a reduced cost. Flat nail clinching strips are located between the sandwiched upper and lower subfloors. The floorboards disposed above the upper subfloor are secured thereto by a plurality of clinching nails extending through the floorboards, the upper subfloor and into the upper subfloor after deflecting on the flat clinching strips.

26 Claims, 3 Drawing Sheets

U.S. PATENT DOCUMENTS

| | | |
|---|---|---|
| 3,518,800 | 7/1970 | Tank . |
| 3,553,919 | 1/1971 | Omholt . |
| 3,556,569 | 3/1971 | Coke et al. . |
| 3,577,694 | 5/1971 | Omholt . |
| 3,596,422 | 8/1971 | Boettcher . |
| 3,604,173 | 9/1971 | Dahlborg . |
| 3,619,963 | 11/1971 | Omholt . |
| 3,713,264 | 1/1973 | Morgan, Jr. . |
| 3,946,529 | 3/1976 | Chevaux . |
| 4,085,557 | 4/1978 | Tharp . |
| 4,087,948 | 5/1978 | Mellor . |
| 4,090,338 | 5/1978 | Bourgade . |
| 4,170,859 | 10/1979 | Counihan . |
| 4,184,304 | 1/1980 | Merchant . |
| 4,441,293 | 4/1984 | McQueen et al. . |
| 4,443,989 | 4/1984 | Silvey et al. . |
| 4,449,342 | 5/1984 | Abendroth . |
| 4,589,243 | 5/1986 | Abendroth . |
| 4,644,720 | 2/1987 | Schneider . |
| 4,676,036 | 6/1987 | Bessert . |
| 4,685,259 | 8/1987 | Eberhart et al. . |
| 4,694,627 | 9/1987 | Omholt . |
| 4,759,164 | 7/1988 | Abendroth et al. . |

FREE FLOATING FLOOR SYSTEM AND METHOD FOR FORMING

This application is a continuation-in-part of applicant's co-pending U.S. application Ser. No. 07/162,088, filed on Feb. 29, 1988, and scheduled for issuance on May 23, 1989 as U.S. Pat. No. 4,831,806, which application is expressly incorporated by reference herein in its entirety.

FIELD OF THE INVENTION

This invention relates to a hard wood floor system and more particularly to a monolithic-like, free floating hard wood floor system.

BACKGROUND OF THE INVENTION

Hard wood floor systems are used for a variety of purposes, most notably in indoor athletic facilities, such as gymnasiums, to provide a playing surface for basketball, or racquetball for example. For athletic activities in particular, wooden floors are generally preferred over other playing surfaces because wood wears slowly and uniformly, provides high abrasion resistance and uniform resilience with only modest maintenance costs.

A typical wooden floor system is laid on a base such as a concrete or asphalt slab, or a preexisting floor. An intermediate support means or layer is secured to the base and a top layer is secured to the support surface and forms the actual playing surface. A layer of filler made of a foam or cushion material may reside between the base and the intermediate support layer or between the top layer and the intermediate layer. The top playing surface generally comprises a plurality of parallel rows of hard wood maple floorboards laid end to end and secured to the underlying support layer by nails. The thickness of the floorboards is usually a standard 25/32 of an inch, or 33/32 of an inch. The width of the floorboards is also standard, typically either 1½" or 2¼" wide. Preferably, the floorboards in each row are staggered with respect to those in adjacent rows, for reasons which will be discussed later. Also, the relative vertical relationship between adjacent rows of floorboards is maintained by providing a tongue on one side and a mating groove on the other side of each floorboard. The floorboard tongues from one row reside within the floorboard grooves of the adjacent row.

The support means for a hard wood floor system is of critical importance. Such support layer must retain the individual floorboards in a set position. Wood floor systems undergo expansion due to ontake of moisture by the wood, either by direct application or from humidity. The relatively long, thin floorboards of a hard wood floor system are particularly susceptible to such expansion. Expansion of one floorboard will exert horizontal forces upon adjacent floorboards and result in displacement and/or warping.

Typically, to provide resiliency, the support layer is made of wood sleepers or other wood based devices. However, these substances are also susceptible to expansion from moisture and/or warping. Expansion of floorboards and/or the support means can buckle or vertically displace top portions of the floor, or even cause the securing nails to be pulled out. Moreover, if the support layer is secured to the base, expansion forces will have adverse effects on the securement means. To alleviate these problems, hard wood floor systems have recently been designed to float freely over the substrate with no mechanical attachment.

There are currently at least three types of free floating floor systems. These include a sleeper type, a single layer panel type with embedded nailing beds and a double-layer panel type.

A sleeper type system utilizes lengths of wood laid end to end in parallel rows in a direction which is perpendicular to the desired longitudinal direction of the floorboards. Typically, each sleeper is 4 feet long, 2½" wide and 1½" thick. The individual sleepers are staggered with respect to the sleepers in adjacent rows, and the sleeper rows are generally spaced on 12" centers.

Each individual floorboard is secured to the underlying, intersecting sleepers by driving nails diagonally through the side of the floorboard and into the sleeper below. Thus, no portion of the securing nails is exposed on the top of the playing surface.

The sleepers may not be secured to the base, thus providing a free-floating floor. While the sleepers themselves provide substantial resistance to floor buckling, there is still the possibility of sleeper warpage and resultant floor buckling. Moreover, such sleeper systems require minimum base to floor surface dimensions, due to the thickness of the sleepers. Where such a floor is to be installed over a preexisting floor, the actual floor surface may be several inches higher than the original floor, especially in older gymnasiums. This could result in extensive and expensive building modifications involving door heights, threshold treatment, basket or other equipment height adjustment and the like.

Another type of free floating floor system is commonly referred to as a panel system. In a panel system, the support layer provides an intermediate layer of wood between the playing surface and the base. The intermediate layer generally comprises a plurality of rows of panels laid end to end to cover the entire surface area of the base.

Such a panel system does not have the voids defined between the sleeper rows of a sleeper system. In a panel system, the floorboards are uniformly supported beneath the entire surface area. A panel floor system is better able to support a high point load, as compared to the sleeper system. Support for a high point load is necessary to accommodate bleachers or lift trucks, or any other heavy object which must be used to bear upon a relatively small portion of the top surface of the floor. Overall, the panel system provides equal dimensional stability in all directions.

A typical panel support system comprises a plurality of 4'×4' or 4'×8' panels, having an overall thickness of 1⅛", laid end to end in parallel rows above the base. The panels typically have parallel rows of grooves milled in the top surface and aligned with the grooves of adjacent panels. Nailing beds are disposed in these grooves and are secured to the panel below, typically by some type of vertically directed fastener mechanism, or in some cases by adhesive. The floorboards are laid over the panels, perpendicular to the grooves, and secured to the beds with nails. Typically, the nailing beds comprise a metal channel filled with a wood strip, or a wood strip disposed between upper and lower metal plates. The nails are driven diagonally through the floorboards, into the strip to strike the metal base of the securing strip at the channel bottom surface and eventually curl toward the floorboard within the channel, to be clinched in place in the bed material. Some securing strips provide a thin, nail-penetratable metal layer above the wood.

Floor holding nails extend through the upper metal strip into the wood nail holding strip.

Such panel systems have proved advantageous in providing dimensional stability for a free floating floor system. However, the wooden securing strips are susceptible to splitting both when the nails are inserted and through normal wear of the floor system. Moreover, use of a plurality of modular panels of this type results in a plurality of independent subfloors, with each subfloor susceptible to warping and/or tension caused by expansion of adjacent subfloors.

Although the tongue and groove relationship between adjacently lying floorboards prevents relative vertical displacement of adjacent rows of floorboards, the tongue and groove does not prevent a whole series of floorboards from being displaced vertically. Failure of the mechanical fasteners used to secure a strip to a respective panel would allow the strip, and all the floorboards attached thereto, to be displaced in an upward direction, away from the base. Once the fastening means have failed, but for the weight of the floorboards, there is nothing to restrain upward motion of the securing strip caused by expansion forces.

Another disadvantage results from the fact that, after the floorboards have been secured to the strips residing underneath, there is no way of testing or monitoring the wear and tear of the fasteners. If any of the fasteners should fail, such failure would not be discovered until after the floorboards have already warped, at a time when it is too late to correct the problem.

A further disadvantage of a panel floor system is of an economic nature. Panels of wood having dimensions of 4'×4' or 4'×8' with a thickness of 1⅛" must be bought, grooved, and shipped from the manufacturer to the location where the floor is to be installed, increasing cost.

Another type of free floating floor system is commonly referred to as a double layer panel type. In a double layer panel system, the maple floorboards are secured to an upper subfloor of panels which is disposed over, and preferably secured to, a lower subfloor of panels. The floorboards are secured by securing nails which are driven therethrough and into the subfloor.

Although the double panel system overcomes some of the problems associated with the single panel system, the double panel system does not provide the advantages afforded by clinching the nails into nailing beds. Moreover, if a double panel system were adapted to utilize nailing beds, in order to clinch the nails, the tendency of the bed material to split would simply be incorporated into the floor system.

In some cases, it is desirable to insulate the floor system from a room which is located below. For example, a school might have a library located beneath a gymnasium. This can be done with acoustic matter or padding disposed below the panels. In other cases, it is desirable to make the floor more resilient. This can be done by providing a layer of close cell synthetic material beneath the panels.

In either case, the desire to insulate or make more resilient comes at the expense of the performance life of the new floor. By placing the insulating or resilient material beneath the panels, the floor is made more flexible, which is desirable. However, flexing of the floorboards tends to pull on or loosen some of the securing nails, which in turn can cause loosening or even movement of the floorboards. In some cases, the resulting differential movement of the floorboards causes the floor system to squeak or buckle during use.

It is therefore one objective of the invention to provide an improved free-floating floor, of minimal thickness and having positive floorboard securement without requiring securing strips.

A further objective of the invention has been to provide an improved free-floating, less expensive floor.

Another object of this invention is to provide a free floating panel floor system which is not susceptible to vertical displacement of adjacent floorboards or subfloor modules resulting from raising of a securing strip.

It is a still further object of this invention to provide a free floating panel floor system which individual panels are less susceptible to horizontal expansion forces caused by adjacent panels.

It is still another object of this invention to provide a free floating panel floor system which is both lower in purchase price and less expensive to ship, as compared to current systems.

It is still another object of this invention to provide a system which is long lasting, having increased resiliency without premature fastener pullout.

SUMMARY OF THE INVENTION

To these ends, one embodiment of the invention includes a monolithic-like free floating panel floor system having upper and lower overlapping subfloor panels and a flat nail clinching strip disposed between the subfloor panels. In one embodiment as particularly mentioned in my parent application, a plurality of parallel grooves are milled into the bottom surface of the upper subfloor panels. In either case, a plurality of floorboards are disposed above the upper subfloor panels, perpendicular to the clinching strips. The floorboards are secured to the upper subfloor panels above the clinching strips by nails driven through the floorboards and into the upper subfloor, whereupon they engage a clinching strip and curl upwardly into the upper subfloor panel in a fish-hook shape whereby they are clinched securely.

The use of two overlapping subfloors, adhered or fixed together in a layered or sandwiched configuration, with the upper subfloor disposed above and secured to the lower subfloor so that all of the joints of the bottom subfloor are lapped, results in a monolithic-like floor system which provides stability against horizontal expansion forces. As opposed to prior modular panel systems, each panel in a monolithic system is restrained because it is secured to three or more other such panels on a top or bottom surface thereof. Overlapping adhered panel layers are less likely to expand independently in a horizontal plane than one layer of modular panels. Thus, the overlapped subfloors provide a floor system which is exceedingly high in resistance to buckling. Although not critical, the upper subfloor panels and the lower subfloor panels are preferably disposed at an angle ranging from about 45° to about 135°.

In the preferred embodiment particularly described in the parent case, the clinching strips are disposed in the grooves noted above. Such grooves are pre-cut in the appropriate surface of the subfloor panels. It will be appreciated that the invention as described in the parent application broadly is directed to a flooring system and methods wherein a clinching strip is disposed between the upper and lower subfloor panels in a predetermined orientation such that nails driven through the elongated floorboards extend through the upper subfloor panel, engage the strip and are then curled back into the upper subfloor for a secure clinch.

While placement of the strip in a precut groove is one advantageous means of providing the advantages sought, the strips can be merely laid between two subfloor panels with no precut groove. In such a case compression of the subfloor panels together, either during manufacture (such as by running the composite elements through a pinch roller) or by the installer, may cause the strip to compress into one or both subfloor panels and to form indentations therein. Both the clinching strips and the floorboards secured thereto are physically restrained from being displaced vertically, and do not rely upon mechanical attachment means between the clinching strips and the subfloor. The floor nails hold the floorboards directly to the upper subfloor panel; not to any strip or other device. In other words, this panel system eliminates both the need to mechanically fasten securing strips and the damage caused by failure of such mechanical fastening means.

Use of two thinner subfloor layers to constitute the subfloor also results in a savings in shipping costs for the end-user. In the preferred embodiment of the parent application, only the upper subfloor must be preworked to mill the grooves. The lower subfloor can be purchased by the buyer at or near the location of the floor system, thus alleviating the cost of shipping the lower subfloor from a site of manufacture to the end-user location. In another embodiment of the parent application, no grooves are milled and both the upper and lower subfloor panels can be purchased by the buyer at or near the location site.

Additionally, the total cost of materials for the monolithic panel system of this invention is reduced by using two layers of panels having $\frac{1}{2}''$ thickness as opposed to one layer of panels having a $1\frac{1}{8}''$ thickness, for example. As the thickness of a wood panel increases, the cost of fabricating increases at a rate which is disproportionately higher. For a given floor area, the cost of two $\frac{1}{2}''$ thick panels is less than one 1" thick panel. In other words, to achieve a desired height, it is cheaper to use a double layer of panels that have a thickness equal to half the desired height than it is to simply use one layer of panels having a thickness equal to the desired height. Thus, due to the use of two layers, even if the manufacturer must ship the entire upper and lower layers to the site, this invention produces a savings in the total cost of wood. Moreover, there is no need to construct and install a composite securing strip such as a metal channel and wood, nail-holding filler.

These and other objectives and advantages of the invention will be further appreciated from the following detailed description of a preferred embodiment thereof and from the drawings in which:

DETAILED DESCRIPTION OF A PREFERRED EMBODIMENT

Figure 1:
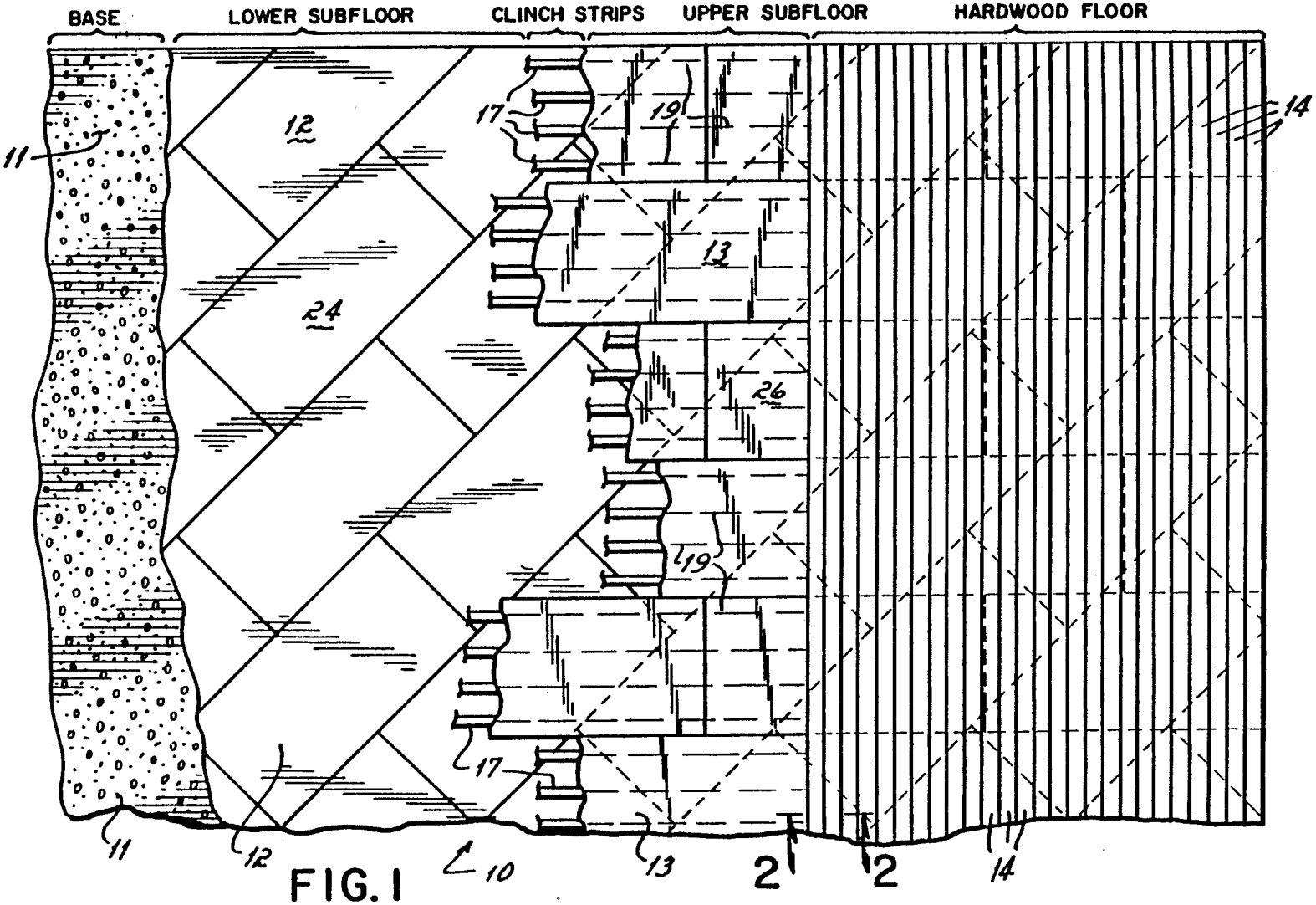
FIG. 1 is a top plan view of the free floating panel floor system of this invention, broken away to illustrate the various underlying components of the system.

A free floating panel floor system 10 of this invention is shown in FIG. 1. A base or substrate layer 11, shown at the left, is the bottommost support surface for the entire floor system 10. Typically, base 11 will be of concrete, asphalt, a pre-existing floor or other suitable base. If desired, a layer of leveling or insulating components, in the nature of a foam or cushion (not shown) may be placed immediately upon base 11. A lower subfloor layer 12 of panels is disposed upon, but not secured to, base 11, preferably at an angle of 45° with respect to the sides of the area to be floored or to the intended direction of the floorboards to be described. An upper subfloor layer 13 of panels is secured by adhesive, nails, staples or other means over the lower subfloor 12, preferably at an angle ranging from about 45° to about 135° with respect to the lower subfloor layer 12. In FIG. 1, the lower subfloor 12 is lain on a bias, and upper subfloor 13 is disposed at about a 45° angle thereto, thus overlapping all the joints of the subfloors. Parallel rows of hard wood floorboards 14 are disposed above and secured to upper subfloor 13, all as seen from left to right in FIG. 1. The system 10 is preferably free floating because there is no direct mechanical attachment between its components and base 11.

Figure 4:
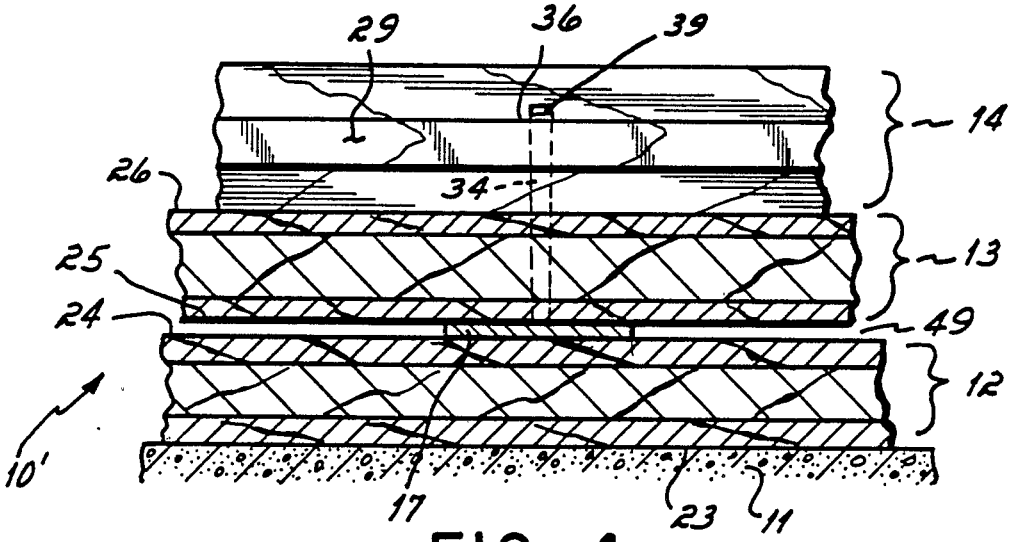
FIG. 4 is a view similar to FIG. 3 for another embodiment of the invention.

FIG. 4 shows a plurality of metal nail clinching strips 17 disposed, or sandwiched between the lower subfloor panels and the upper subfloor panels. The clinching strips 17 are shown in FIG. 1 extending out from the bottom of upper subfloor 13. The floorboards 14 are secured to the upper subfloor in general perpendicular disposition thereto. The nail clinching strips 17 are preferably about 22–24 gauge thick, and about $1\frac{1}{2}''$–2" wide. The upper surface of upper subfloor 13 on which floorboards 14 are laid has elongated markings 19 to indicate the position of the nail clinching strips 17.

Preferably, the lower subfloor 12 comprises a plurality of $4\times8$ wooden panels having a thickness of a half inch. The lower subfloor 12 panels are laid end to end in parallel rows at a preferred, predetermined angle of 45° to the predetermined floorboard disposition. Preferably, the panels in adjacent rows of panels are staggered so that no joints continue across two rows.

The panels comprising the upper subfloor 13 are also laid end to end in parallel rows, in staggered fashion. The upper subfloor 13 is disposed above the lower subfloor 12 at a preferred angle of 45°. The strips 17 run parallel with the major length of upper panels 13 and perpendicular to the predetermined longitudinal direction of the elongated floorboards 14. The strips 17 might also run perpendicular to the longitudinal direction of the upper subfloor 13 panels, so long as the strips 17 and the floorboards 14 intersect at right angles. Although the angle between the lower subfloor 12 and the upper subfloor 13 is not critical, it is important that all the joints of the lower subfloor 12 are overlapped by an upper panel to provide, in effect, a monolithic panel system when the panels are glued, fastened or otherwise secured together. The system is said to be monolithic because the subfloors are layered, lapped and secured. Unlike modular panel systems, in which any one panel of a plurality of independent subfloors can exert adverse horizontal forces upon adjacent panels, possibly resulting in vertical displacement, buckling of and/or warping, each panel in a monolithic system is vertically secured to, and restrained by, a number of overlying or underlying panels. This lapped, secured structure significantly reduces buckling caused by the exertion of horizontal expansion forces upon the floorboards 14.

Figure 2:
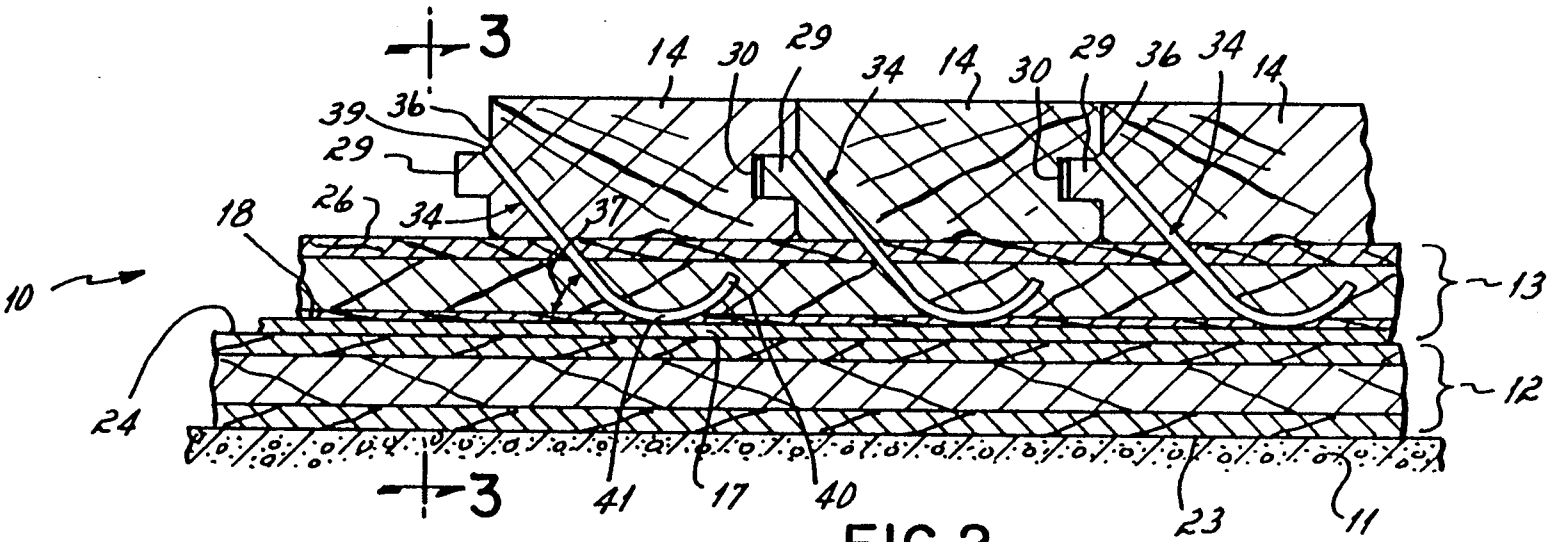
FIG. 2 is a cross sectional view of one embodiment of the invention taken along lines 2—2 of FIG. 1.

Lower subfloor 12 has a bottom surface 23 resting upon base 11, and a top surface 24 opposite the bottom surface 23. A bottom surface 25 of upper subfloor 13 resides upon top surface 24 of lower subfloor 12, and is secured thereto, preferably by glue (not shown). Alternately, glue can be used with suitable fasteners, or fasteners can be used alone. The floorboards 14 are disposed above a top surface 26 of upper subfloor 13. The floorboards 14 typically include a tongue 29 on one side and a mating channel or groove 30 on the opposite side, as shown in FIG. 2. With the channel 30 and the tongue 29 of adjacent rows of floorboards 14 cooperating in this manner, and the floorboards 14 secured to the upper subfloor 13, adjacent rows of floorboards 14 are prevented from relative vertical displacement.

The floorboards 14 are secured to upper subfloor 13 by a plurality of clinching nails 34. The nails 34 are preferably inserted at a position 36 located above tongue 29 and in register with indicaters 19. Nails 34 are driven at an angle with respect to the horizontally residing floor system 10, through the floorboard 14 and into the upper subfloor 13. The angle of insertion is designated by arrows 37 shown in FIG. 2. Preferably, the angle of insertion is about 53°.

As noted, each nail 34 is positioned to be inserted and driven at a marking 19 on top surface 26 which indicates the position of a clinching strip 17 below. Preferably, each nail 34 is driven downward at the aforementioned angle until it contacts a clinching strip 17 and is curled back up in subfloor 13 toward top surface 26. Each driven nail 34 has a first end 39 or top portion residing adjacent tongue 29, a second, bottom end 40 directed upwardly toward top surface 26, and an intermediate portion 41 bowed or curled away from the clinching strip 17. With the nails 34 securing the floorboards 14 directly to upper subfloor 13, and the clinching strip 17 residing beneath upper subfloor 13, restrained from vertical displacement, a free floating panel floor system of this invention provides optimum rigidity and integrity for a hard wood floor system. There are no securing strips to assemble, insert and secure.

Figure 3:
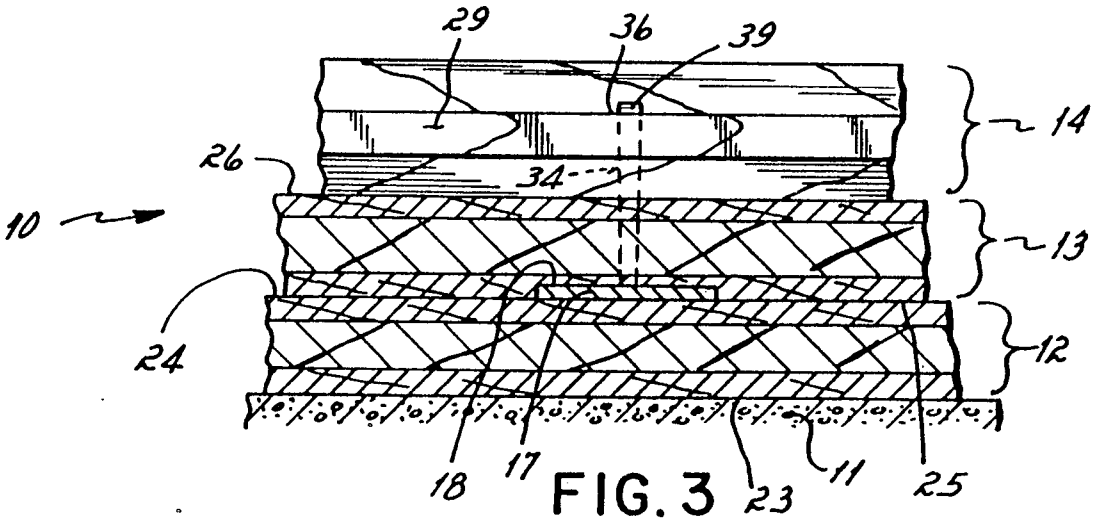
FIG. 3 is a cross sectional view taken along lines 3—3 of FIG. 2.

In a method of installing the free floating panel floor system 10 of this invention, the lower subfloor 12 is laid upon the supporting surface or base 11. An upper subfloor 13 is secured to the top surface 24 of the lower subfloor 12 at an angle with respect to the lower subfloor, in order to overlap all the lower subfloor 12 joints, with the flat clinching strips disposed therebetween, preferably in parallel relation. Although there may be some void space 40 between the upper 13 and lower 12 subfloors, as shown in FIG. 4, securement of the upper 13 and lower 12 subfloors may compress the strips 17 into one or both of the subfloor panels, thus forming indentations therein. In effect, portions of the resulting subfloor may appear more like the embodiment shown in FIG. 3 than the embodiment of FIG. 4. A plurality of floorboards 14 are disposed, one row at a time, above top surface 26 of upper subfloor 13. The floorboards 14 are secured to the upper subfloor 13 by clinching nails 34, driven through a floorboard, and the upper subfloor 13 at marking 19 to a point where it engages the clinching strip 17 and curls back into the upper subfloor 13, toward top surface 26. The driving of the clinching nails 34 may further compress the strips 17 into one or both of the subfloor layers. Again, this compression may form indentations along part of, or all of, the length of the strips 17.

Alternately, prior to securement of the upper 13 and lower 12 subfloors, the strips 17 can be adhered by applying tacking adhesive to either the top surface 24 of lower subfloor 12 or the bottom surface 25 of upper subfloor 13 at premarked locations. If desired, an underlayment of this type can be made by the manufacturer in the shop, and then shipped to the job site. This could be accomplished by compressing upper 13 and lower 12 panels onto the strips 17 with pinch rollers to form 4′×8′ unitary subfloor panels.

Once installed, the floor system 10 of this invention floats freely above base 11. Its rigidity provides optimum assurance against buckling. Each panel of the lower subfloor 12 has all its joints lapped, and thus is restrained by at least a portion of several other overlying, secured panels of the upper subfloor 13. Likewise, each panel of the upper subfloor 13 is secured to several underlying panels of the lower subfloor 12. In such a monolithic system, no single panel or row of panels can expand independently of the other panels. Thus, compared to a modular panel system, a monolithic panel system significantly reduces horizontally displacement and/or buckling of the floorboards 14 or panels resulting from moisture expansion.

By locating the clinching strip 17 beneath the bottom surface 25 of the upper subfloor 13, upward displacement of the clinching strip is prevented. Moreover, this is accomplished in a manner which eliminates both the need to mechanically fasten the strips 17, and the accompanying danger presented by failure of the mechanical attachment means, namely, vertical displacement of a whole series of adjacent floorboards 14.

The use of two subfloors to create the panel system provides a strong, buckling resistant support for a hardwood floor, yet at a reduction in the total cost of wood required to provide the panel system as compared to prior panel systems. No pre-installation work needs to be performed on either the lower subfloor 12 or the upper subfloor 13, resulting in reduced manufacturing costs. Moreover, both subfloors can be purchased by the buyer at or near the location of installation, resulting in overall reduced shipping costs for a panel type floor system.

In other alternate embodiments of this invention, the lower subfloor layer may comprise either close cell synthetic or other cushioning material to provide increased resilience or acoustical matting or padding to provide audio insulation. In these embodiments, the upper subfloor can be secured to the lower subfloor by glue or other means, or simply disposed thereon.

In another variation of the preferred embodiment of the parent case, the strips 17 residing between the upper 13 and lower 12 subfloors may reside in grooves 18 milled during manufacture or formed by compression during installation in the top surface 24 of the lower subfloor 12 panels.

Other modifications and advantages will become readily apparent to one of ordinary skill in the art, without departing from the scope of this invention, and applicant intends to be bound only by the claims appended hereto.

We claim:

1. A free floating floor system comprising:

an upper subfloor having a bottom surface;

a plurality of flat nail clinching strips underlying said upper subfloor, said bottom surface of said upper subfloor engaging said strips;

a plurality of floorboards disposed on said upper subfloor, said floorboards being substantially coextensive with said upper subfloor; and a plurality of clinching nails extending through said floorboards and into said upper subfloor above said clinching strips to secure said floorboards to said upper subfloor wherein the clinching strips remain in the floor system.

2. A free floating floor system as in claim 1 wherein each said extending clinching nail has an intermediate section curling away from said clinching strip into said upper subfloor.

3. A free floating floor system as in claim 1 wherein portions of each said clinching nail in said floorboards reside at a predetermined angle with respect to said clinching strip.

4. A free floating floor system as in claim 3 wherein said predetermined angle is about 53° with respect to said clinching strip.

5. A free floating floor system as in claim 1 further including markings in the top surface of said upper subfloor in register with the location of said strips residing beneath said bottom surface thereof.

6. A free floating floor system as in claim 1 wherein said clinching strips are metal and have a thickness ranging from about 22 to 24 gauge.

7. A free floating floor system as in claim 1 wherein said strips are spaced on centers of about 12" apart.

8. A free floating floor system comprising:

a lower subfloor having a top surface;

an upper subfloor having a bottom surface, said upper subfloor disposed above the lower subfloor with the bottom surface thereof substantially coextensive with said lower subfloor top surface;

a plurality of nail clinching strips disposed between said upper subfloor and said lower subfloor;

a plurality of floorboards disposed above said upper subfloor; and a plurality of clinching nails extending through said floorboards and into said upper subfloor above said clinching strips to secure said floorboards to said upper subfloor wherein the clinching strips remain in the floor system.

9. A free floating floor system as in claim 8 wherein said upper subfloor is secured to said lower subfloor.

10. A free floating floor system as in claim 8 wherein said nailing strips are compressed between said subfloors to form indentations in one of the bottom surface of said upper subfloor and the top surface of said lower subfloor.

11. A free floating floor system as in claim 8 wherein said lower subfloor comprises wood panels.

12. A free floating floor system as in claim 8 wherein said lower subfloor comprises closed cell synthetic material.

13. A free floating floor system as in claim 8 wherein said lower subfloor comprises acoustical matting.

14. A method of preparing a free floating floor system comprising the steps of:

laying a lower subfloor upon a base;

disposing flat clinching strips above said lower subfloor;

laying an upper subfloor above said lower subfloor and upon said strips, the upper subfloor and the lower subfloor being in substantial facing orientation with said strips and with each other beyond said strips;

marking a top surface of the upper subfloor in register with the locations of said strips;

disposing floorboards above said upper subfloor; and securing the floorboards to the upper subfloor along said markings thereby to provide securement of the floorboards to the upper subfloor above the strips.

15. The method of claim 14 and further comprising the steps of:

securing the upper and lower subfloors together to hold the clinching strips therebetween.

16. The method of claim 15 and further comprising the step of:

adhering, prior to said disposing and securing steps, said strips to one of a top surface of the lower subfloor and a bottom surface of the upper subfloor.

17. The method of claim 16 and further comprising the step of:

marking, prior to said adhering step, the location for said strips to be adhered.

18. A method of installing a floor comprising the steps of:

constructing a subfloor system on a supporting surface including the steps of laying an upper subfloor on and substantially coextensive with a lower subfloor, and with parallel clinching strips disposed therebetween;

securing the upper subfloor to the lower subfloor, capturing said clinching strips therebetween;

laying floorboards on said upper subfloor; and driving clinching nails through a floorboard and through said upper subfloor such that each of said nails engages a clinching strip and curls back into said upper subfloor to secure said floorboard thereto.

19. A method of installing a floor as in claim 18 wherein said upper subfloor has markings on a top surface thereof in register with the location of said strips, and further comprising the step of:

driving said nails through said floorboard into said upper subfloor at said markings such that said nails hit said strip and curl back into said upper subfloor.

20. A method of installing a floor comprising the steps of:

laying a lower subfloor upon a supporting surface;

adhering a plurality of clinching strips to a top surface of said lower subfloor;

laying an upper subfloor on said top surface of said lower subfloor, the upper subfloor having a bottom surface substantially coextensive with the lower subfloor top surface; and driving clinching nails through a floorboard and through said upper subfloor such that each of said nails engages a clinching strip and curls back into said upper subfloor to secure said floorboard thereto.

21. The method of claim 20 and further comprising the step of:

marking, prior to said adhering step, the locations for said clinching strips.

22. The method of claim 21 and further comprising the step of:

securing prior to said driving step, said upper and lower subfloors to compress said adhered clinching strips therebetween.

23. A method of installing a floor comprising the steps of:

laying a lower subfloor upon a supporting surface;

disposing a plurality of clinching strips upon a top surface of said lower subfloor;

laying an upper subfloor on said top surface of said lower subfloor and over said clinching strips, the upper subfloor having a bottom surface, the lower subfloor top surface and the upper subfloor bottom surface being substantially coextensive; and driving clinching nails through a floorboard and through said upper subfloor such that each of said nails engages a clinching strip and curls back into said upper subfloor to secure said floorboard thereto, said clinching strips remaining in the floor system.

24. A method of preparing a unitary, multiple component underlayment panel for a floor system comprising the steps of:

compressing a plurality of parallel disposed, flat, nail clinching strips between substantially abutting faces of an upper subfloor component and a lower subfloor component; and securing opposed faces of said upper and said lower subfloor components together in areas beyond said strips thereby securing said strips and said upper and lower subfloor components together in a unitary, underlayment panel for a floor system, said strips adapted to provide clinching deflection for nails driven through floorboards overlying said panel when said panel is incorporated in a floor system.

25. A floor system comprising:

a lower subfloor having top and bottom surfaces;

an upper subfloor having top and bottom surfaces and disposed over the lower subfloor;

a plurality of nail clinching strips disposed between said upper subfloor and said lower subfloor, said upper subfloor bottom surface and said lower subfloor top surface being in substantial facing orientation with said strips and with each other beyond said strips;

a plurality of floorboards disposed above said upper subfloor; and a plurality of clinching nails extending through said floorboards and into said upper subfloor above said clinching strips to secure said floorboards to said upper subfloor.

26. A floor system comprising:

a layer of lower subfloor panels;

a layer of upper subfloor panels, said upper and lower layers having opposed faces;

flat nail clinching strips disposed between said opposed faces of said upper and lower layers of panels and said upper and lower subfloor panels having said opposed faces disposed adjacent each other beyond said strips;

an uppermost floor surface disposed on said upper layer of panels; and fasteners extending through said uppermost floor surface into said upper layer of panels in register with said flat strips.

* * * * *